US005240246A

United States Patent [19]

Gohil et al.

[11] Patent Number: 5,240,246

[45] Date of Patent: Aug. 31, 1993

[54] GOLF BALL RETRIEVAL DEVICE AND METHOD

[76] Inventors: Dharmendrasinh R. Gohil; Indrajitsinh D. Gohil, both of Rte. 2, Box 182 D, Hwy. 9 Bypass, Loris, S.C. 29569; John B. Clark, Jr., 1025 Hwy. 544, Apt. B-3, Conway, S.C. 29526; Ronald L. Gaskins, Rte. 3, Box 129 D, Tabor City, N.C. 28463

[21] Appl. No.: 797,404

[22] Filed: Nov. 25, 1991

[51] Int. Cl.[5] ..... A63B 57/00; A63B 69/36

[52] U.S. Cl. ..... 273/32 R; 43/7; 273/181 R; 273/181 F

[58] Field of Search ..... 273/176, 181, 32, 35; 43/7, 8, 14

[56] References Cited

U.S. PATENT DOCUMENTS

| | | | |
|---|---|---|---|
| 2,310,702 | 2/1943 | Ljubetich et al. | 43/14 |
| 2,455,806 | 12/1948 | Reach | 273/176 A |
| 2,751,703 | 6/1956 | Kietz et al. | 43/8 |
| 2,767,501 | 10/1956 | Bjorksten | 43/7 |
| 2,874,505 | 2/1959 | Cobile | 93/7 |
| 3,314,679 | 4/1967 | Kolln | 273/176 A |
| 3,413,005 | 11/1968 | Stearns | 273/181 A |
| 3,649,025 | 3/1972 | Garland | 273/176 A |
| 3,797,827 | 3/1974 | Child | 273/176 A |
| 3,830,004 | 8/1974 | Poirot | 43/8 |

FOREIGN PATENT DOCUMENTS

| | | | |
|---|---|---|---|
| 1069304 | 1/1980 | Canada | 43/7 |
| 898101 | 4/1945 | France | 43/7 |
| 1191324 | 10/1959 | France | 43/7 |
| 2187921 | 9/1987 | United Kingdom | 43/8 |

*Primary Examiner*—Mark S. Graham
*Attorney, Agent, or Firm*—Roger D. Emerson

[57] ABSTRACT

A golf ball retrieving device for retrieving submerged golf balls from lakes includes a net which has an edge about its periphery. Attached to the net's edge is hollow pipe which is selectively fillable with air or water to raise or lower the net respectively. At the center of the net is a receptacle for receiving golf balls. When the golf balls are to be removed from the receptacle, the hollow pipe is filled with air, causing the edges of the net to rise. The rising edges of the net cause the golf balls to roll toward the center of the net where they are retained by the receptacle. The receptacle is then easily lifted and the golf balls contained therein removed.

10 Claims, 4 Drawing Sheets

FIG-4
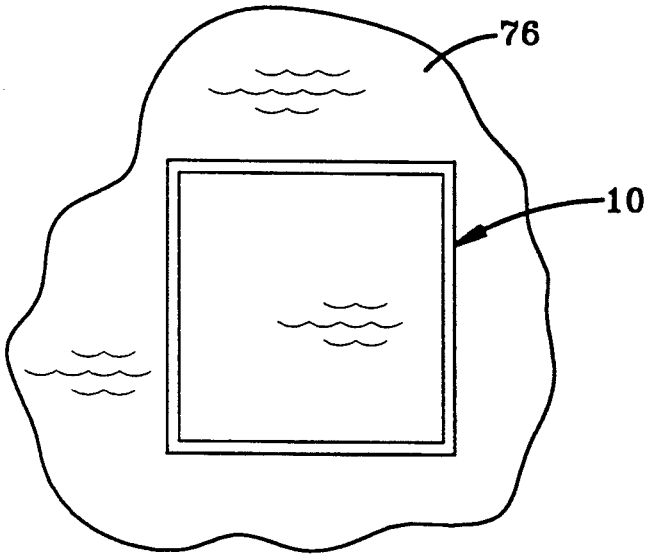
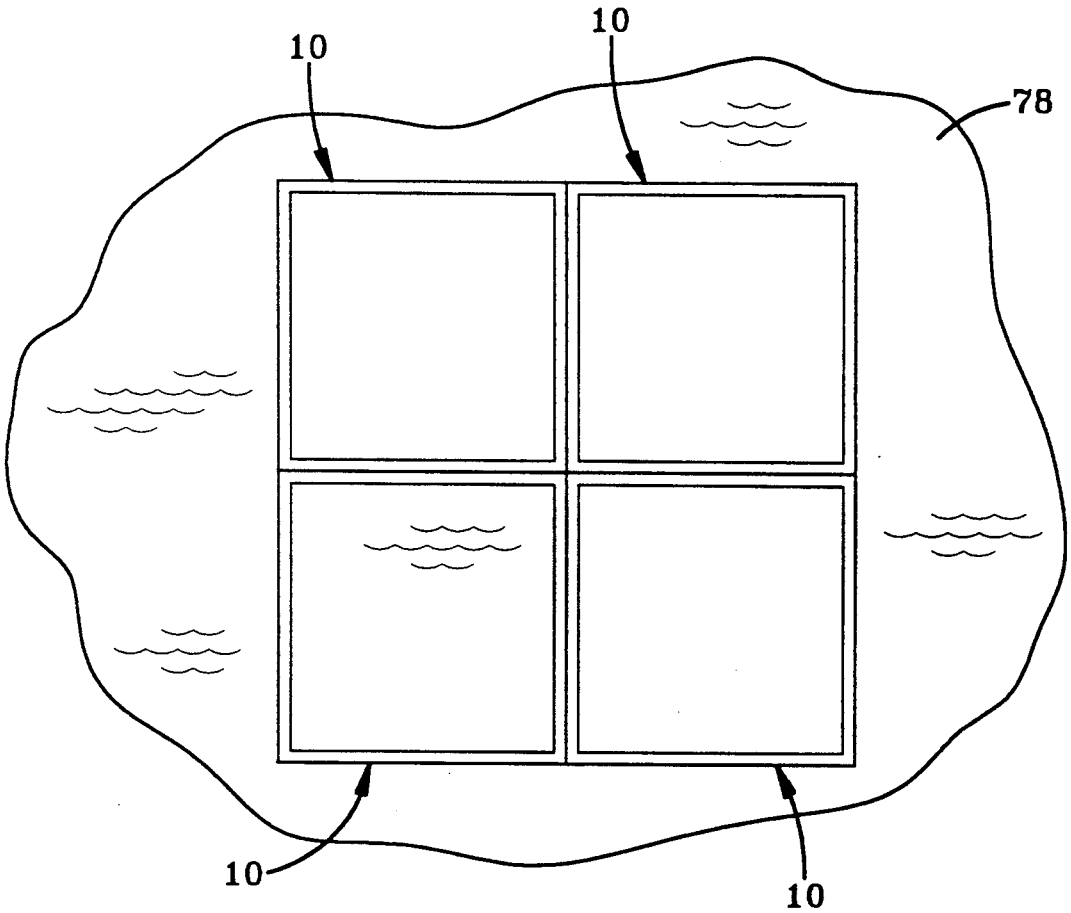
FIG-5

GOLF BALL RETRIEVAL DEVICE AND METHOD

BACKGROUND OF THE INVENTION

1. Field of Invention

This invention pertains to the art of golf ball retrieval devices and methods, and more particularly to a golf ball retrieval device which is submersible into a pond or lake.

2. Description of the Related Art

Golf is an increasingly popular sport worldwide. The pleasure and challenge of playing golf is increased by the presence of various hazards on golf courses. These hazards typically take the form of sand traps, strategically-placed trees and water hazards. The water hazards can be ponds, rivers, lakes, or even sea coasts if the golf course is located near an ocean.

Due to the high level skill required to play golf consistently well, it is very common for golfers to mishit their golf balls and drive them into these bodies of water. It has been known in the art to periodically gather golf balls from these bodies of water and resell them as a source of revenue to the golf course.

Various retrieval means have been implemented but primarily such retrieval is made by divers utilizing compressed air breathing apparatus or by dragging devices through the lake to gather the golf balls. The use of divers is expensive and dangerous as well as slow. The use of various implements drug through the lake has the disadvantage of disturbing the lake environment and raising silt and mud from the bottom of the lake and dispersing it throughout the lake's water. This contributes to an unsightly appearance for several days, or even weeks, and disturbs the vegetation and marine life of the lake.

For this reason, a less intrusive, more environmentally sound method of retrieving golf balls from the bottom surfaces of lakes was desirable.

The present invention contemplates a new and improved golf ball retrieval device which is simple in design, effective in use, and overcomes the foregoing difficulties and others for providing better and more advantageous overall results.

SUMMARY OF THE INVENTION

In accordance with the present invention, a new and improved golf ball retrieval device is provided which effectively retrieves golf balls from the bottom surfaces of lakes.

According to one aspect of the invention, a membrane has a peripheral edge and water passageways. The water passageways allow water to pass therethrough, but not golf balls. Floatation means is affixed to the peripheral edge of the membrane and selectively raises the peripheral edge of the membrane. When the peripheral edge is so raised, golf balls located on the top surface of the membrane are displaced toward a center of the membrane and gathered within a receptacle.

According to another aspect of the invention, a golf ball retrieving device comprises a net and raising means. The net has an edge about its periphery and has openings therein sized to retain golf balls. The raising means comprises a hollow body which is selectively fillable with water or air.

According to another aspect of the invention, a first supply means supplies pressurized air to the hollow body while a second supply means supplies water to the hollow body. A basket is affixed to the net near the center of the net.

According to another aspect of the invention, a buoy has a floatation member and a rope. A first end of the rope is affixed to the basket and a second end of the rope is affixed to the floatation member. The buoy is used by an operator of the device to retrieve the basket from the bottom surface of the lake and remove golf balls contained within the basket.

According to another aspect of the invention, a golf ball retrieving apparatus for use in retrieving submerged golf balls from the bottom of lakes comprises a net, a hollow pipe, first supply means for supplying pressurized air, second supply means for supplying pressurized water, a basket, and a buoy. The net has openings sized to retain golf balls within the net. The net also has a center and edges about its periphery. The hollow pipe is affixed to the net about the peripheral edge of the net and is selectively fillable with air or water through the inlet and outlet. The first supply means is operative to fill the hollow pipe with air. The second supply means is operative to fill the hollow pipe with water. The basket is affixed to the net in the center of the net and is suitably sized to receive and retain golf balls hit into the lake and caught by the net. The basket has a weight at the bottom to keep it on the lake bottom surface until it is retrieved by the operator. A buoy is attached to the basket by rope. The basket is raisable from the bottom surface of the lake by the rope.

According to another aspect of the invention, a method of retrieving submerged golf balls from lakes comprises the steps of:

spreading a net over the surface of an associated lake, the net having hollow members about its periphery and receptacle near its center;

sinking the net by filling the hollow members with water;

waiting a sufficient amount of time for a number of golf balls to be hit into the lake;

displacing water within the hollow members by filling the hollow members with pressurized air until the hollow members begin to float, thereby pulling the periphery of the net upward and moving golf balls within the net into the receptacle;

raising the receptacle to the surface of the lake by means of a rope; and, removing the golf balls from the receptacle.

One advantage of the present invention is the provision of a membrane which captures and gathers errant golf balls and concentrates them in a smaller area by means of floatation.

Another advantage of the present invention is the use of low cost materials, such as water and air, to retrieve submerged golf balls.

Another advantage of the present invention is that it operates effectively without any moving parts and few mechanical parts of any kind.

Another advantage of the present invention is its environmentally safe operation. Plant and marine life within a lake are not disturbed by the operation of the inventive device.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangements of parts, a preferred embodiment of which will be described in detail in this specification. Further, the preferred embodiment will be illustrated in the accompanying drawings which form a part hereof and wherein:

FIG. 4 is a schematic plan view of a typical application of the invention within a lake; and, FIG. 5 is a schematic plan view of a plurality of the inventive devices linked together within a typical application.

DESCRIPTION OF THE PREFERRED EMBODIMENT

Figure 1:
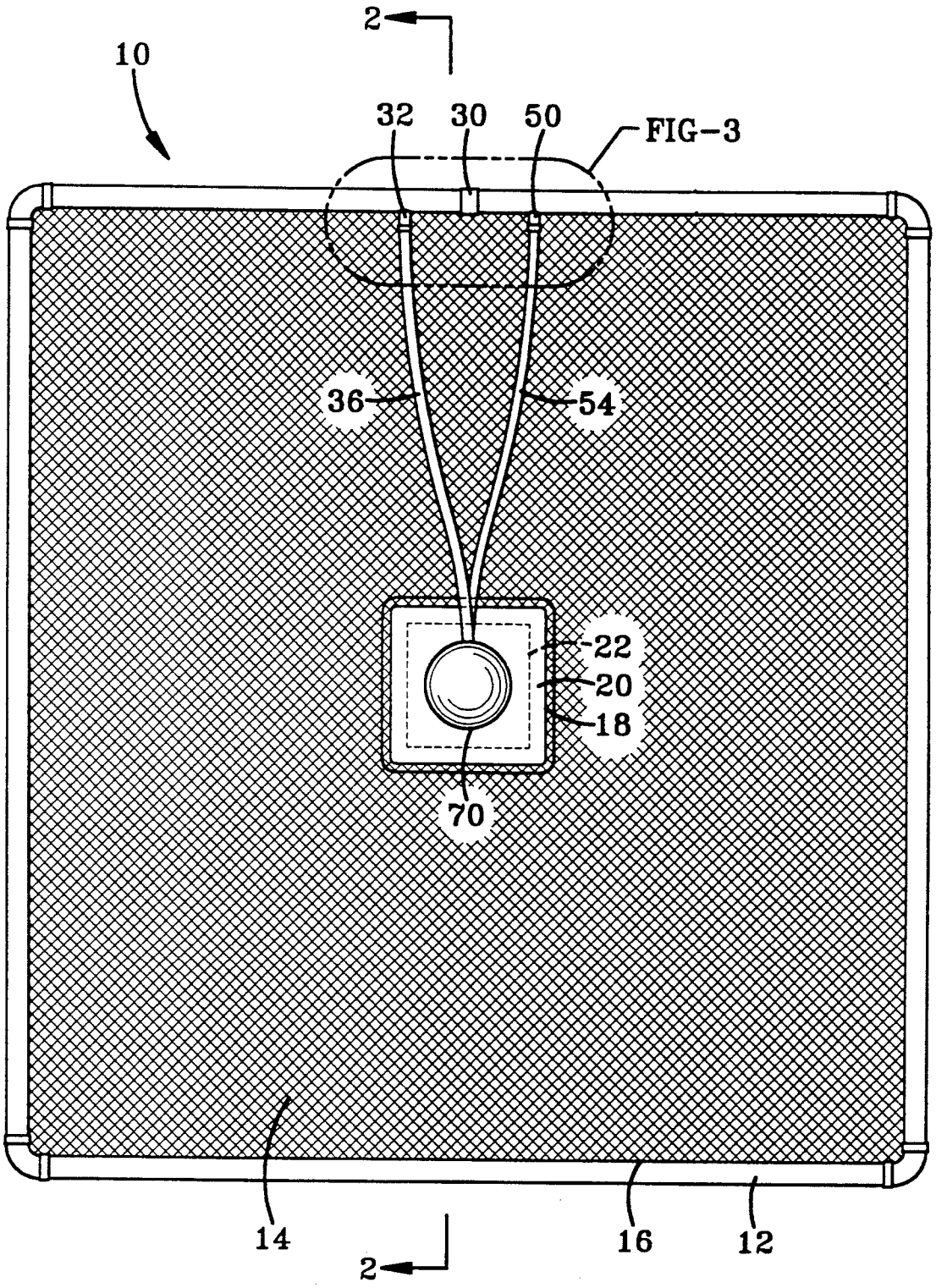
FIG. 1 is a schematic plan view of a golf ball retrieving device according to the invention.

Referring now to the drawings wherein the showings are for purposes of illustrating a preferred embodiment of the invention only and not for purposes of limiting the same, FIG. 1 shows a plan view of a golf ball retrieving device 10 according to the invention. The device 10 comprises hollow pipe 12 built into a generally rectangular configuration. In the preferred embodiment, the device 10 is 17 feet by 15 feet and is manufactured out of PVC plastic pipe having an interior diameter of 1.5 inches. However, any suitable hollow body which can be filled with air and floated could work in the device and the invention should not be limited to the particular hollow member chosen. In addition, different shaped members of different sizes are also considered within the invention.

Attached to the hollow pipe 12 is a net 14. The net 14 is sized to retain golf balls hit therein. In the preferred embodiment, the net 14 has openings of 1" square although this particular size opening is not considered critical to the invention as long as the golf balls can be retained within the net 14. About the peripheral edge 16 of the net 14, the net 14 is attached to the pipe 12 by means of plastic tying means (not shown). The preferred net material is nylon. Near the center 18 of the net 14 is a basket 20. In the preferred embodiment, the basket 20 is made of plastic. Plastic is the material chosen for the basket 20 and for the means of tying the net 14 to the pipe 12 due to its durability when submerged in water.

Figure 2:
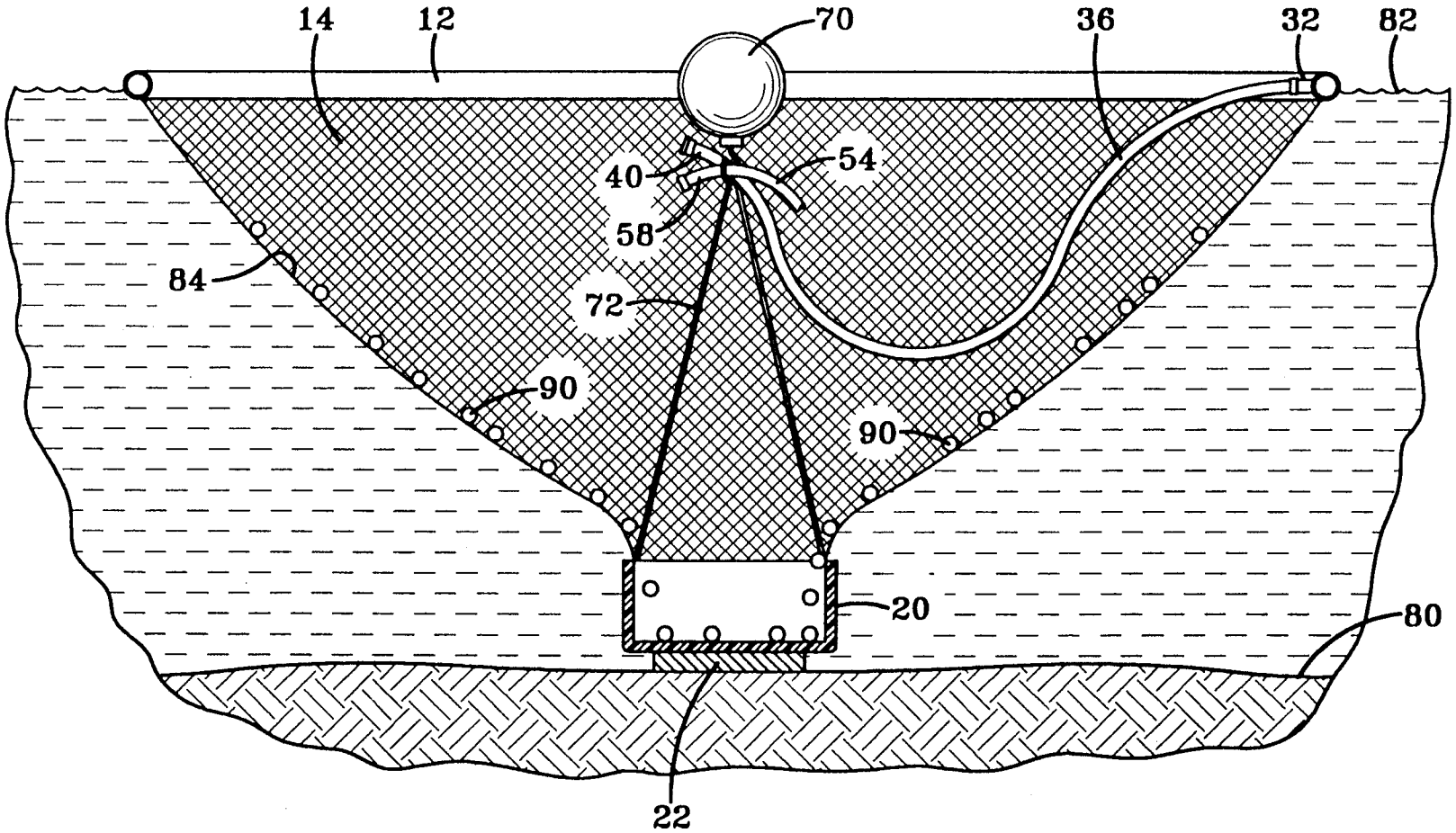
FIG. 2 is a side elevational view of a golf ball retrieval device according to the invention.

As is most easily seen in FIG. 2, a weight 22 is attached to the bottom of basket 20 to help retain the basket 20 on the bottom surface 80 of the lake 76. In the preferred embodiment, this weight 22 is a slab of concrete.

Figure 3:
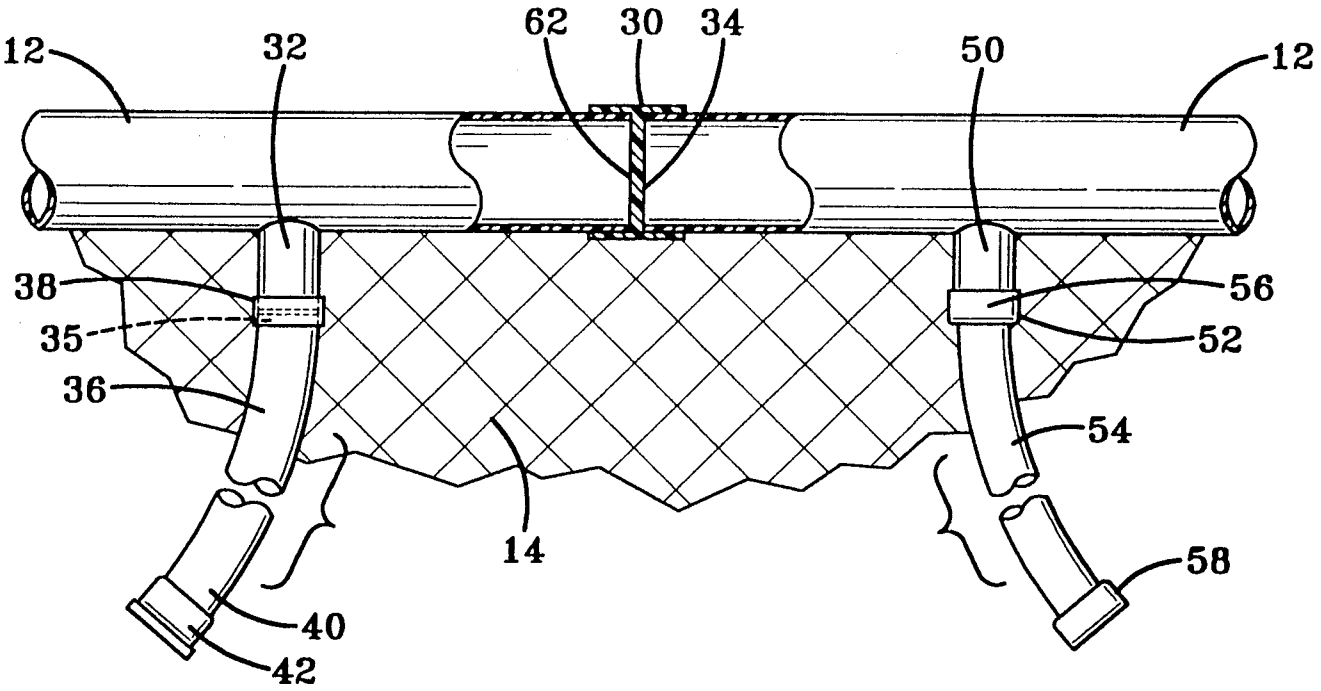
FIG. 3 is an enlarged, schematic plan view of the inlet and outlet of the invention.

With reference to FIGS. 1 and 3, the pipe 12 is joined together so that it comprises a single unbroken passageway except for the presence of a plug 30. The plug 30 prevents the passage of water or air from one side of it to the other. Any sort of plug 30 can be used as long as air or water cannot freely pass through it. In the preferred embodiment, the plug 30 was created by fitting a conventional cap as is typically used in PVC pipe within the open ends of the pipe 12.

On one side of plug 30 is an air inlet 32. The air inlet 32 selectively receives pressurized air. Pressurized air entering air inlet 32 passes throughout the entire periphery of the pipe 12 until it reaches the water side 34 of plug 30.

A first end 35 of a flexible hose 36 is attached to the air inlet 32 by means of an attaching means 38. In the preferred embodiment, the attaching means 38 is a "C" clamp, although any appropriate attaching means which allows the compressed air to enter the air inlet 32 is suitable. A second end 40 of the flexible hose 36 is attached to a quick connect 42. The quick connect 42 can be any of a variety of suitable types commonly available. The function of the quick connect 42 is to connect to the outlet of an associated supply of compressed air. This supply of compressed air could be a metal cylinder or an air compressor or the like.

A water inlet 50 is on the water side 34 of the plug 30. A first end 52 of a second flexible hose 54 is attached to the water inlet 50. In the preferred embodiment, the second flexible hose 54 is a common garden variety hose such as is used in residential and commercial applications. The first end 52 is attached to the water inlet 50 by means of a commonly available female fitting 56. The second end 58 of the second flexible hose 54 is attached to a source of pressurized water. In the preferred embodiment, the source of pressurized water is a common faucet such as is available in a residential or commercial tap water line. When the first end 52 of the second flexible hose 54 is attached to the water inlet 50, pressurized water enters the water inlet 50 and progresses through the hollow pipe 12 until it reaches the air side 62 of the plug 30.

With reference to FIG. 2, a buoy 70 is attached to the basket 20 by means of ropes 72. In addition, the second ends 40, 58 of the first and second flexible hoses 36, 54 are removably attached to the bottom of the buoy 70.

The operation of the inventive device will now be explained. With reference to FIG. 4, the device 10 is placed in the lake 76 where desired. Typically, the device 10 is located in water several feet deep to discourage aggressive golfers from entering the water to retrieve errant golf balls. By the golfers doing so, the device 10 could be damaged by the weight of the golfer or by various hand-held retrieval devices they may have in their bag.

With reference to FIGS. 1–4, in the typical application of a single device 10 utilized in a lake 76, the device 10 is sunk at the appropriate location by attaching the first end 52 of the second flexible hose 54 to the water inlet 50 and turning on the water supply so that pressurized water enters the water inlet 50 and passes throughout the periphery of the hollow pipe 12. When the water reaches the air side of the plug 30, pressure will increase until no more water can enter the system. In another embodiment, the water could be allowed to exit the pipe 12 through air inlet 32. At this time, the first end 52 of the second flexible hose 54 can be removed and, due to the weight of the water contained within the hollow pipe 12, the hollow pipe 12 will sink to the bottom surface 80 of the lake 76. The buoy 70 will remain on the top surface 82 of the lake.

After a sufficient amount of time has passed, a number of golf balls will have been hit into the lake 76 and will have sunk toward the bottom surface 80. For those golf balls falling within the confines of the device 10, these golf balls will actually fall onto an upper surface 84 of the net 14. When the golf balls 90 are to be retrieved, an operator can attach the quick connect 42 to a source of compressed air. In the preferred embodiment, this is accomplished by loading a portable air compressor into a row boat and rowing the compressor out to the buoy 70. The quick connection 42 is attached to the source of compressed air. When the air enters the air inlet 32, it displaces the water contained within the hollow pipe 12. The water so displaced is forced out of water inlet 50. When the hollow pipe 12 is filled with air, the hollow pipe 12 rises due to buoyant forces. As it does, it pulls the outer peripheral edge 16 of the net 14 upward, as can be seen in FIG. 2. Due to the weight 22 at the bottom of basket 20, and the raised edge 16 of the net 14, an incline is formed which causes golf balls 90 retained within the net 14 to roll downwardly into the basket 20. The basket 20 is then retrieved by the operator pulling on ropes 72 and bringing the basket 20 to the surface 82 of the lake 76.

After the golf balls 90 have been removed from the basket 20, the basket 20 is allowed to sink to the bottom surface 80 of the lake 76. Next, the water inlet 50 is attached to a source of pressurized water. In the preferred embodiment, this is a garden hose attached to tap water. When the pressurized water enters the water inlet 50, it displaces the air contained within the hollow pipe 12 and moves throughout the hollow pipe 12 until reaching the air side 62 of the plug 30. At this point, the source of water is turned off and the hollow pipe 12 is allowed to sink to the bottom surface 80 of the lake 76 until such time as the golf balls 90 are to be retrieved again.

It is important that the length of ropes 72 and the length of flexible hose 36, 54 be sized for the depth of the lake in question. This can be easily done when the depth of the lake in its desired location is known.

With reference to FIG. 5, a plurality of golf ball retrieval devices 10 are joined together about their edges to cover the bottom of a larger lake 78. In such an embodiment, it is preferred that a single air inlet 32 and water inlet 50 selectively empty and fill each of the hollow pipes 12 within the plurality of devices 10. However, the device is operable with separate air and water inlets 32, 50 for each of the devices 10 displayed in FIG. 5. Each of the devices 10 shown in FIG. 5 would have its own individual buoy 70 and basket 20. As such, the operator would require four raisings of the individual baskets 20 involved.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A golf ball retrieving apparatus for retrieving golf balls from water bodies, said apparatus comprising:

a net, said net having an edge about its periphery and having a center, said net having openings therein sized to retain golf balls within said net;

raising means for raising said net upward from a bottom of an associated lake to a surface of said lake, said raising means comprising at least one hollow body, said hollow body selectively fillable with water or with air, said raising means affixed to said net about its periphery;

a basket, said basket having upper edges, said upper edges of said basket being affixed to said net near said center of said net; and, a buoy, said buoy having a flotation member and a rope, said rope having first and second ends, said first end of said rope being affixed to said basket and said second end of said rope being affixed to said floatation member.

2. A golf ball retrieving apparatus for use in retrieving submerged golf balls from the bottoms of lakes, said retrieving apparatus comprising:

a net, said net having openings sized to retain golf balls within said net, said net having a center and having edges about its periphery, said net being rectangularly shaped;

hollow pipe, said hollow pipe having a certain volume, said pipe affixed to said net at said edges of said net, said hollow pipe having an inlet and an outlet, said hollow pipe selectively fillable with air or water through said inlet and outlet;

an air supply means for supplying pressurized air to said hollow pipe for selectively displacing water within said hollow pipe;

a water supply means for supplying pressurized water for selectively displacing air within said hollow pipe;

a basket affixed to said net near said center of said net, said basket suitably sized to receive and retain golf balls hit into said associated lake; and, a buoy attached to said basket by a pipe, whereby when said hollow pipe is filled with air and begins to rise, golf balls within said net roll into said basket which is locatable and raisable by said rope on said buoy.

3. The golf ball retrieving apparatus of claim 2 wherein said hollow body is rigid plastic pipe.

4. A method of retrieving submerged golf balls from lakes, said method comprising the steps of:

spreading a net over the surface of an associated lake, said net having hollow members about its periphery and a receptacle near its center;

sinking said net by filling said hollow members with water;

waiting sufficient time for a number of golf balls to be hit into said lake;

displacing said water within said hollow members with air until said hollow members being to float, pulling said periphery of said net upward and moving golf balls within said net into said receptacle;

raising said receptacle to said surface of said lake; and, removing said golf balls from said receptacle.

5. The method of claim 4 wherein said receptacle is raised by pulling on a rope attached at one end to said receptacle and at another end to a buoy.

6. The method of claim 4 wherein said water is displaced from said hollow members by pressurized air.

7. The method of claim 4 wherein said hollow members are plastic pipe.

8. The method of claim 4 further comprising the steps of, after removing said golf balls from said receptacle;

resinking said net by filling said hollow members with water.

9. A golf ball retrieving apparatus for use in retrieving submerged golf balls from bodies of water, said retrieving apparatus comprising:

a net, said net having openings sized to retain golf balls within said net, said net having a center and having edges about its periphery, said net being rectangularly shaped;

hollow pipe, said hollow pipe having a certain volume, said pipe affixed to said net at said edges of said net, said hollow pipe having an inlet and an outlet, said hollow pipe selectively fillable with air or water through said inlet and outlet;

an air supply means for supplying pressurized air to said hollow pipe;

a water supply means for supplying pressurized water to said hollow pipe;

pressurized air or water, one of said pressurized air or water being within said pipe and selectively displacing the other from within said hollow pipe, said air displacing said water to raise said pipe and said water replacing said air to sink said pipe;

a basket affixed to said net near said center of said net, said basket suitably sized to receive and retain golf balls hit into said associated lake; and, a buoy attached to said basket by a pipe, whereby when said hollow pipe is filled with air and begins to rise, golf balls within said net roll into said basket which is locatable and raisable by said rope on said buoy.

10. A method of retrieving submerged golf balls from lakes, said method comprising the steps of:

spreading a net over the surface of an associated lake, said net having hollow members about its periphery and a receptacle near its center;

sinking said net;

waiting sufficient time for a number of golf balls to be hit into said lake;

filling said hollow members with air until said hollow members being to float, pulling said periphery of said net upward and moving golf balls within said net into said receptacle;

raising said receptacle to said surface of said lake; and, removing said golf balls from said receptacle.

* * * * *